US011150026B2

(12) United States Patent
Van Kasteren

(10) Patent No.: US 11,150,026 B2
(45) Date of Patent: Oct. 19, 2021

(54) HEAT EXCHANGER

(71) Applicant: RECAIR B.V., Waalwijk (NL)

(72) Inventor: Marinus Henricus Johannes Van Kasteren, Waalwijk (NL)

(73) Assignee: RECAIR B.V., Waalwijk (NL)

( * ) Notice: Subject to any disclaimer, the term of this patent is extended or adjusted under 35 U.S.C. 154(b) by 358 days.

(21) Appl. No.: 16/064,199

(22) PCT Filed: Oct. 5, 2016

(86) PCT No.: PCT/NL2016/050687
§ 371 (c)(1),
(2) Date: Jun. 20, 2018

(87) PCT Pub. No.: WO2017/111578
PCT Pub. Date: Jun. 29, 2017

(65) Prior Publication Data

US 2019/0003774 A1 Jan. 3, 2019

(30) Foreign Application Priority Data

Dec. 21, 2015 (NL) ..... 2015996

(51) Int. Cl.
*F28D 9/00* (2006.01)

(52) U.S. Cl.
CPC ..... *F28D 9/0037* (2013.01); *F28D 9/0025* (2013.01)

(58) Field of Classification Search
CPC ..... F28D 9/0037; F28D 9/0025; F28F 3/025; F28F 3/046; F28F 21/065
See application file for complete search history.

(56) References Cited

U.S. PATENT DOCUMENTS 3,608,629 A 9/1971 Cowans
3,847,211 A 11/1974 Fischel et al.
6,098,706 A * 8/2000 Urch ..... F28D 9/0025 165/166
2013/0045411 A1* 2/2013 Bauer ..... H01M 10/613 429/120
2014/0326432 A1* 11/2014 Dean ..... F28F 9/26 165/54

FOREIGN PATENT DOCUMENTS

DE 102018003050 A1 * 10/2019 ..... F28F 3/025
EP 0 829 692 A2 3/1998

OTHER PUBLICATIONS

DE 102018003050 A1 MT (Year: 2019).*
International Search Report for International Application No. PCT/NL2016/050687 dated Jan. 25, 2017.

* cited by examiner

*Primary Examiner* — Gordon A Jones
(74) *Attorney, Agent, or Firm* — Suiter Swantz pc llo

(57) ABSTRACT

A heat exchanger including a plurality of flat sheets arranged in parallel and a plurality of profiled sheets, each of which including a number of straight segments and being arranged between two subsequent flat sheets and having a repeating profile. The profiled sheets and the flat sheets together create a plurality of parallel ducts arranged in layers. The parallel ducts are divided by the profiled sheets into ducts of a first type and ducts of a second type, the ducts of the second type neighboring the ducts of the first type. Each duct of the first and second type has a width w(d) which is a function of a distance d with d the distance from a first flat sheet.

17 Claims, 4 Drawing Sheets

HEAT EXCHANGER

FIELD OF THE INVENTION

The invention relates to a heat exchanger. It also relates to a method of operating such a heat exchanger.

BACKGROUND ART

Micro heat exchangers (also referred to as micro-scale heat exchangers or micro structured heat exchangers) are heat exchangers in which (at least one) fluid flows in micro channels with cross sectional dimensions typically below 20 mm. A microchannel heat exchanger can be made from several materials such as metal, ceramic or plastic. Microchannel heat exchangers can be used for many applications including high-performance aircraft gas turbine engines, heat pumps, air conditioning and ventilation units with heat recovery.

Channels of the heat exchangers may have all sorts of cross sections. The channels may for example have triangular shaped cross sections. The flow rate in the outer corners of such channels will be relatively low so that the corner parts of the channels do not contribute to the effective heat transfer. This will directly influence the efficiency of heat exchanger.

In publication DE10213543 a heat exchanger is described having channels with rectangular shaped cross sections. The flow speed in such channels is more homogeneous as compared to triangular shaped cross sections. The channels are formed by stacking multiple profiled layers. The profiled layers each have a repetitive profile made of a block wave. To facilitate the stacking, each profiled layer comprises indented corners at their top side to receive the corners of a profiled layers stacked onto it. In this way, the risk of unwanted displacements of the layers is decreased.

Stacking of the profiled layers in micro channel heat exchangers is more challenging than in heat exchanger have larger channels. Although the rectangular shaped channels have a certain advantage, the configuration of DE10213543 is not very suitable for creating micro channels. To avoid the risk of the shifting (and thus collapsing) of the rectangular shaped channel structure, the profiled sheets can be separated by flat sheets. This gives a more stable and thus more firm structure of the micro channel heat exchanger. A disadvantage of such a heat exchanger is that the neighboring layers within the heat exchanger need to be aligned very accurately. If the alignment is not correct, channels of the same type (i.e. transporting fluid with the same temperature) will be in thermal contact. This will reduce the efficiency of the heat exchanger.

SUMMARY OF THE INVENTION

One of the objects of the invention is to provide a heat exchanger in which at least one of the problems of the prior art is solved.

Therefore, according to a first aspect there is provided a heat exchanger comprising a plurality of flat sheets arranged in parallel and a plurality of profiled sheets, each of which being arranged between two subsequent flat sheets and having a repeating profile. The profiled sheets and the flat sheets together create a plurality of parallel ducts arranged in layers, the parallel ducts being divided by the profiled sheets into ducts of a first type and ducts of a second type, the ducts of the second type neighbouring the ducts of the first type. Each duct of the first and second type has a width w(d) which is a function of a distance d with d the distance from a first flat sheet, wherein:

$$w(d)=c1*d \text{ when } 0\leq d<d1,$$

$$w(d)=c1*d1+c2*(d-d1) \text{ when } d1\leq d<d2, \text{ and}$$

$$w(d)=c1*d1+c2*(d2-d1)+c3*(d-d2) \text{ when } d2\leq d<d3$$

in which d3 is a distance between the first flat sheet and a subsequent flat sheet, and wherein d1, d2, c1, c2, c3 are constant values, wherein c2≠c1,c3, and wherein 0<d1<d2<d3.

Starting from the first flat sheet, the duct first has a width equal to zero. This results in a minimal contact with the flat sheet and thus in a minimal thermal contact of the duct with a neighbouring layer. Next, the width linearly increases until the distance d is equal to a value d1. This will result in a substantially triangular shaped first part of the cross section.

In an embodiment, the width of the part of a duct between the distance d1 and d2 increases with a factor c2 in the range between −2≤c2<5, and preferably in a range between −0.3≤c2<0.3. The latter range meaning that the width of the channels is constant or nearly constant over this distance. As a result, the duct will comprise a main part that is substantially rectangular shaped. Between d2 and d3 the width may linearly increase again.

A substantially rectangular shape, which is formed by the second part, will result in an improved effective heat exchanging surface as compared to triangular shaped duct. The minimal thermal contact of the duct with a neighbouring layer, will avoid loss of efficiency in case the layers are not aligned properly. The restriction wherein c2≠c1,c3 is mentioned to exclude a triangular shape, which is a known shape and not part of the invention.

In an embodiment, the width of the duct does not decrease towards the subsequent flat sheet. Such profiled sheets are easy to make using a thermal forming process in which the profiled sheets are manufacture using a mold and a contra mold. After molding the profiled sheet can be sandwiched between the flat sheets and mounted using thermal and/or chemical binding processes with other binding processes not excluded. It is noted that the invention is not restricted to an continuously non-decreasing width. Alternatively, the width in the second part between d=d1 and d=d2 may decrease with increasing value for d.

In an embodiment a cross section of each duct is symmetrical with reference to a perpendicular of the flat sheets. Such a configuration is relatively easy to produce, especially in case of using a thermos forming process. It is noted that in this embodiment, some ducts formed by the flat sheets and the profiled sheets may be different in cross section (i.e. non-symmetrical) due to for example cut off at the sides of the heat exchanger.

Optionally for the constant c2 it count that c2=0. This will result in a rectangular shaped part of the cross section.

Optionally, at least the profiled sheets are formed from thermally deformable plastic. This material is preferred when manufacturing the heat exchanger using a thermoforming process.

In an embodiment, for c2 counts that c2<c1,c3. This means that the ducts are substantially rocket shaped.

In an embodiment, the distance d3 between two neighboring flat sheets has a value in the range between 1 mm and 10 mm. These small dimensions result in a very fine mesh with a good efficiency.

Optionally c1=c3. This means that the angle of the first wall segment and the third wall segment are the same. In an embodiment d1=d3−d2. When combined with the option of c1=c3, this results in an embodiment wherein the length of the first wall segment and the third wall segment are the same. When this occurs, the cross section of the ducts of the first type and ducts the second type are the same. This results in a better balanced flow with equal flow resistance.

The invention also relates to a method of operating a heat exchanger, the method comprising:

providing a heat exchanger as described above;

leading a fluid of a first type through the ducts of the first type;

leading a fluid of a second type through the ducts of the second type.

Other preferred embodiment and their advantages will become clear to the reader when reading the description and the drawings.

BRIEF DESCRIPTION OF THE DRAWINGS

These and other aspects of the invention are apparent from and will be elucidated with reference to the embodiments described hereinafter. In the drawings.

It should be noted that items which have the same reference numbers in different Figures, have the same structural features and the same functions, or are the same signals. Where the function and/or structure of such an item has been explained, there is no necessity for repeated explanation thereof in the detailed description.

DETAILED DESCRIPTION OF EMBODIMENTS

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

In an embodiment, a heat exchanger is provided comprising a plurality of flat sheets arranged in parallel and a plurality of profiled sheets, each of which being arranged between two subsequent flat sheets and having a repeating profile. Due to a special forming process the profiled sheets comprise a number of substantially straight segments or parts. The profiled sheets and the flat sheets together create a plurality of parallel ducts arranged in layers. The parallel ducts are divided by the profiled sheets into ducts of a first type and ducts of a second type, the ducts of the second type neighbouring the ducts of the first type. Each duct of the first and second type has a width w(d) which is a function of a distance d with d the distance from a first flat sheet.

Figure 1:
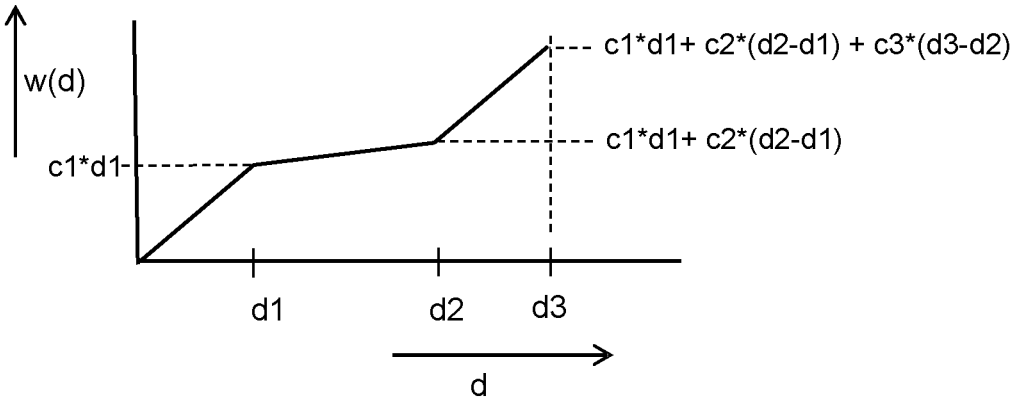
FIG. 1 shows a graph of the width w(d) of a duct as a function of the distance d according to an embodiment.

FIG. 1 shows a graph of the width w(d) of a duct as a function of the distance d. As can be seen from FIG. 1, the width linearly increase in a first part between d=0 and d=d1. Next, the width slowly increases until d=d2. Finally, the width increases linearly to a maximum value. The function w(d) of FIG. 1 can be described as follows:

$$w(d)=c1*d \text{ when } 0\leq d<d1,$$

$$w(d)=c1*d1+c2*(d-d1) \text{ when } d1\leq d<d2, \text{ and}$$

$$w(d)=c1*d1+c2*(d2-d1)+c3*(d-d2) \text{ when } d2\leq d<d3$$

The parameter d3 reflects a distance between the first flat sheet and a subsequent flat sheet. Furthermore 0<d1<d2<d3. In the example of FIG. 1 c1=c3=1 and c2=0.1. It should be noted that c1 and c3 may differ. In an embodiment the value of c2 lies in a range 0≤c2<5. In a preferred embodiment, the value for c2 lies in a range of 0≤c2<0.3.

Figure 2:
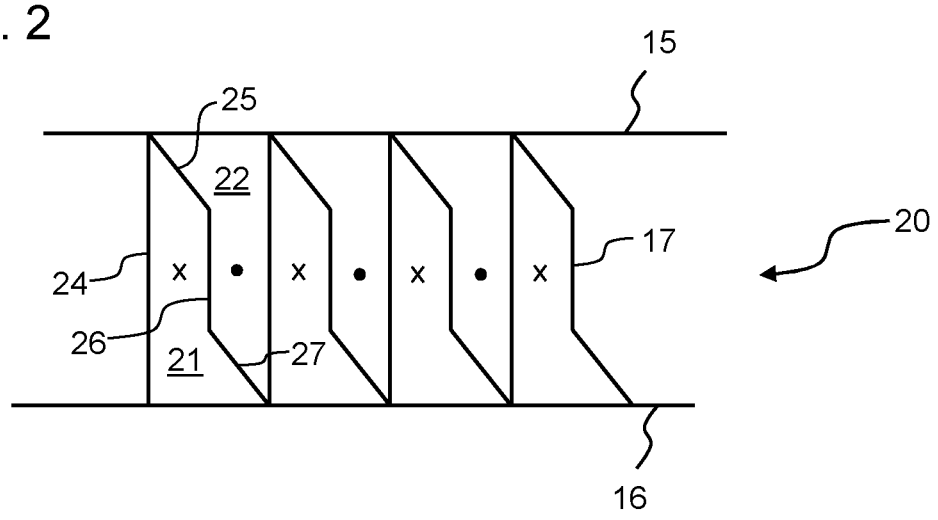
FIG. 2 schematically shows a cross section of part of one layer of a heat exchanger according to an embodiment.

FIG. 2 schematically shows a cross section of part of one layer 20 of a heat exchanger. The heat exchanger comprises a first flat sheet 15 and a neighboring flat sheet 16. The sheets 15 and 16 are arranged in parallel. Between the two flat sheets 15,16 a profiled sheet 17 is arranged. The profiled sheet 17 is formed so as to show a repetitive curved profile. The two flat sheets 15,16 together with the profiled sheet 17 create a plurality of parallel ducts 21, 22. In use, the ducts 21 (also referred to as ducts of the first type) transport a fluid, e.g. air, in a direction into the plane of the paper. The ducts 22 (also referred to as ducts of the second type) transport a fluid in a direction out of the plane of the paper, so opposite of the flow direction in the ducts 21. This type of heat exchanger is referred to a counter flow heat exchanger.

Each of the ducts 21 is enclosed by part of the flat sheet 16, a straight wall 24 and a profiled wall having a first wall segment 25, a second wall segment 26 and a third wall segment 27. In FIG. 2 the second wall segment 26 is arranged in parallel with the straight wall 24 which resembles a value for c2 equal to zero.

Figure 3:
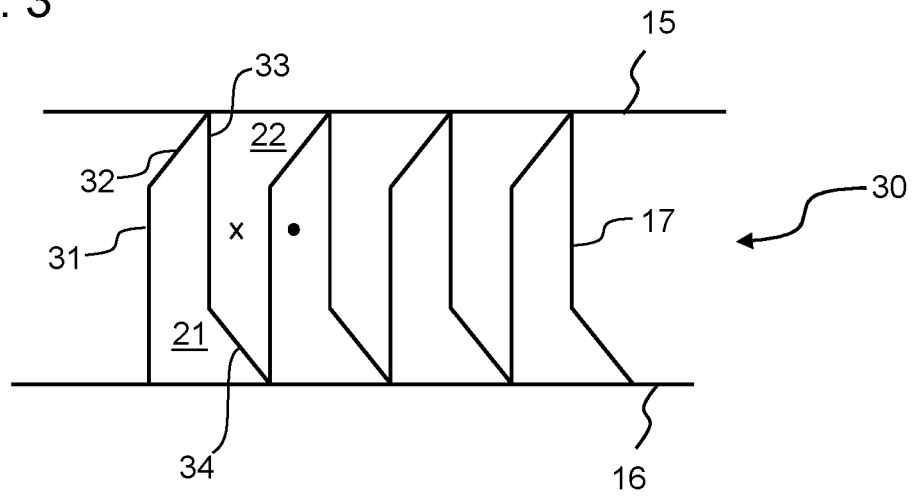
FIG. 3 schematically shows a cross section of part of one layer of a heat exchanger according to a further embodiment.

FIG. 3 schematically shows a cross section of part of one layer 30 of a heat exchanger according to a further embodiment. In this embodiment, the profiled sheet 17 is curved so as to form ducts wherein ducts 21 of the first type have a cross section which is a mirrored version of the cross section of the ducts 22 of the second type. Each of the ducts 21 in FIG. 3 is enclosed by part of the flat sheet 16, a first wall segment 31, a second wall segment 32, a third wall segment 33 and a fourth wall segment 34. It is noted that the wall profiled sheet may be relatively thin. As a consequence the wall segments may be slightly curved due to forces within the heat exchanger or due to the cooling off after a thermoforming process. Note that the wall segments may also be slightly curved on purpose e.g. to reduce stress in the material.

As can be seen from the FIGS. 2 and 3, the ducts 21 of the first type do not have a contact surface contacting the flat sheet 15, except for the point where the tip of the cross section touches the flat sheet 15. This means that contact between these ducts and a layer above (not shown) is kept to a minimum.

Figure 4:
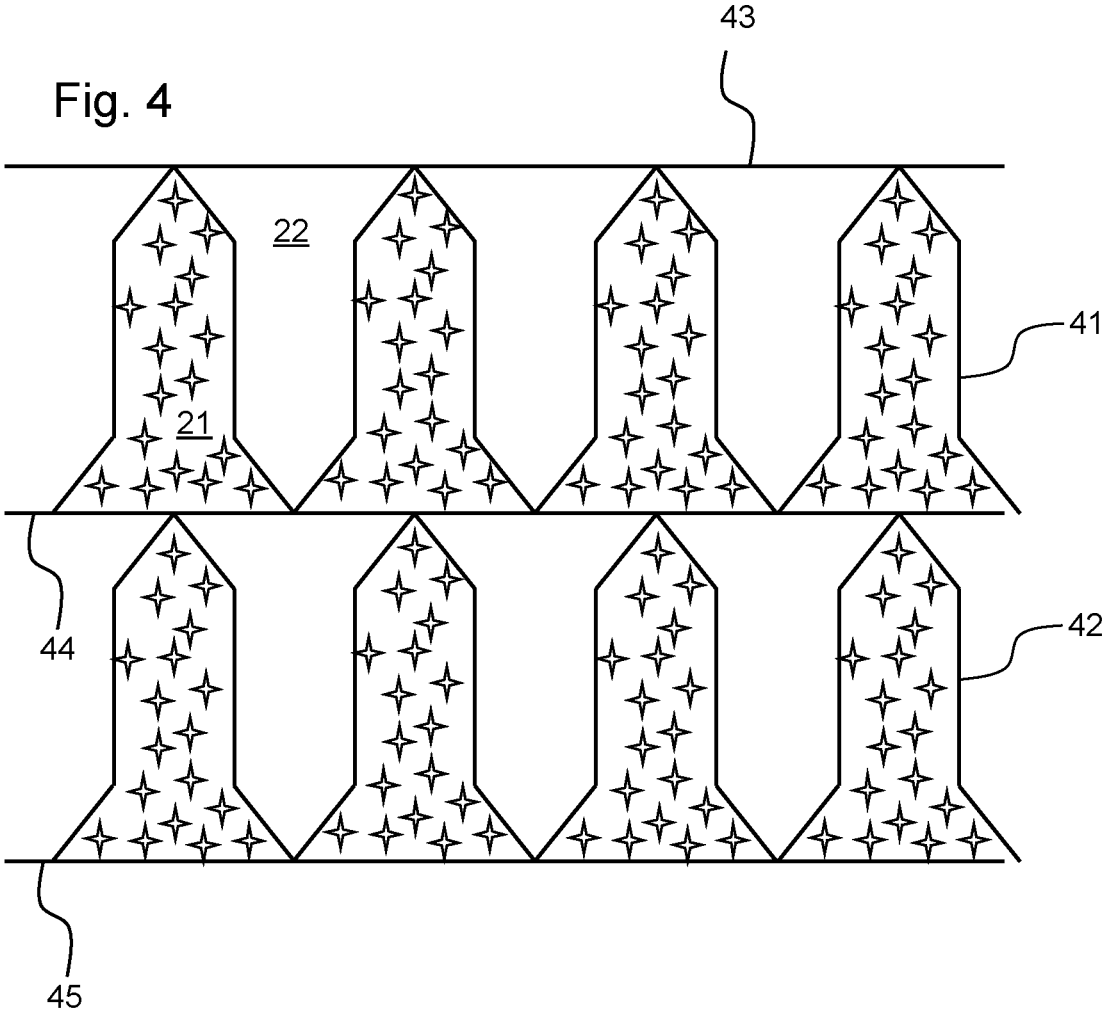
FIG. 4 schematically shows a cross section of part of the heat exchanger according to a further embodiment.

FIG. 4 schematically shows a cross section of part of the heat exchanger according to a further embodiment. In FIG. 4 two layers of the heat exchanger ducts are shown. A first layer comprises a first profiled sheet 41 and a second layer comprises a second profiled sheet 42. In this example, the first profiled sheet 41 and the second profiled sheet 42 have identical profiles. It should however be noted that the profiled sheet in different layers do not have to be identical and that different layers may comprise differently profiled sheets.

In FIG. 4 the duct 21 of the first type are indicated by star symbols, indicating that air in these ducts 21 is colder that the air flowing through the ducts 22 of the second type. It is noted that the invention is not restricted to heat exchanger with counter flow type ducts. Air (or other fluids) may be lead through the ducts of the first type and ducts of the second type in the same direction (so not opposite/reverse direction).

Figure 5:
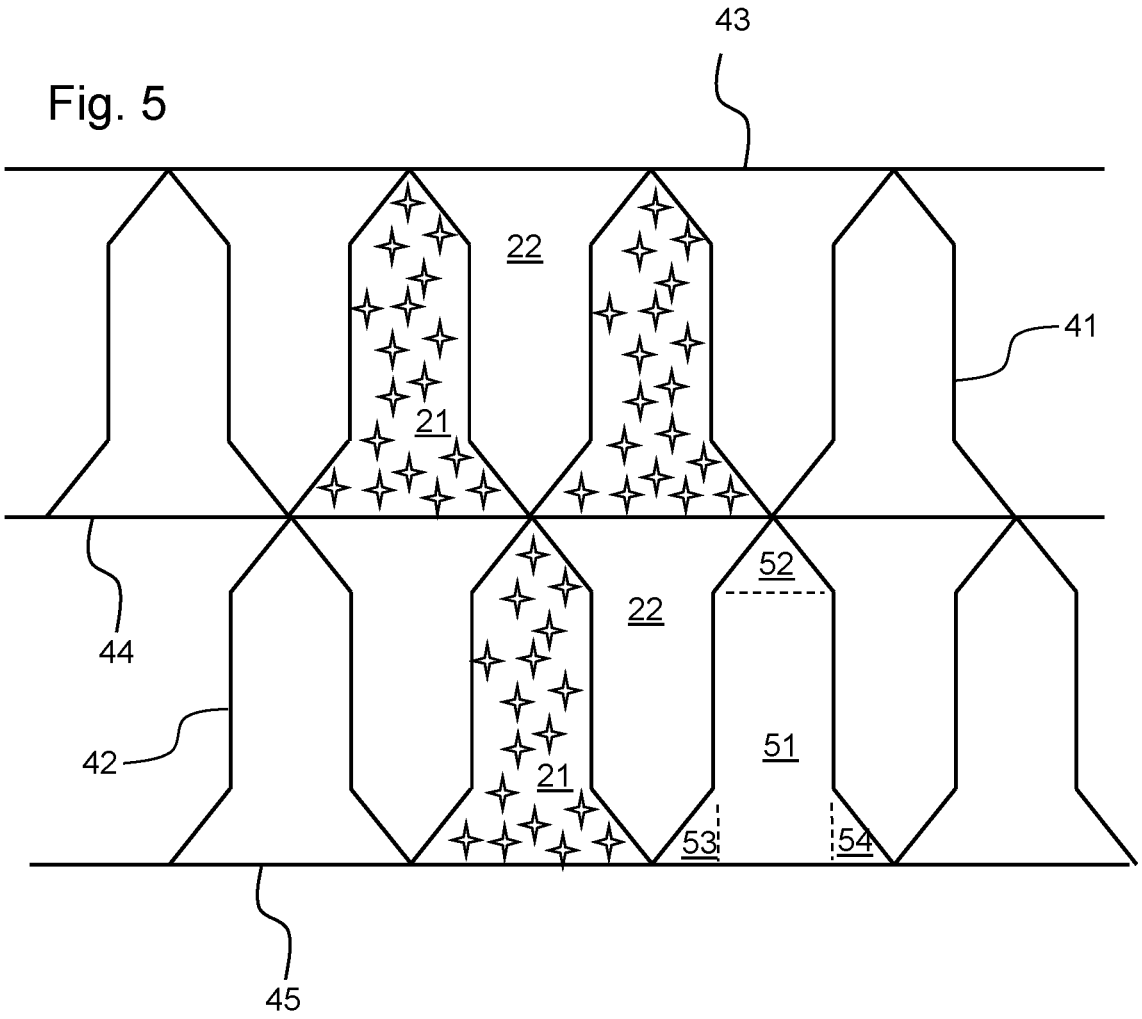
FIG. 5 schematically shows a cross section of part of the heat exchanger according to a further embodiment.

FIG. 5 schematically shows a cross section of part of the heat exchanger according to a further embodiment. In FIG. 5 two layers of the heat exchanger ducts are shown. The layers in this embodiment resemble the layers of the embodiment of FIG. 4, but the layers are slight shifted relative to each other. As can be seen in FIG. 5, the tips of the ducts 21 of the lower layer touches the tips of the ducts 22 in the layer above. This means that there will be no energy exchange at this position between these ducts having different types. This is not a drawback since at other locations on the flat sheet 44 between the tips, the energy exchange is optimal because of an optimal contact between ducts of the first type and the ducts of the second type in a neighboring layer.

The above embodiments all show ducts having a cross section at least comprising a substantially rectangular shaped part and two or three triangular shaped parts. In FIG. 5 the rectangular shaped part is indicated with reference number 51, and the three rectangular shaped parts are indicated by reference numbers 52, 53 and 54 respectively. Preferably, the dimension of the substantially rectangular part 51 is more than 70% of the total cross section of a duct. In the situation where c2=0 and c1=c3=1 this means that the total cross section of the three triangular shaped parts 52, 53, 54 is less than or equal to 20% of the total cross section of a duct.

A preferred height/width ratio of substantially rectangular part 51 is more than 3. Such values gave good results during simulations of the ducts.

Figure 6:
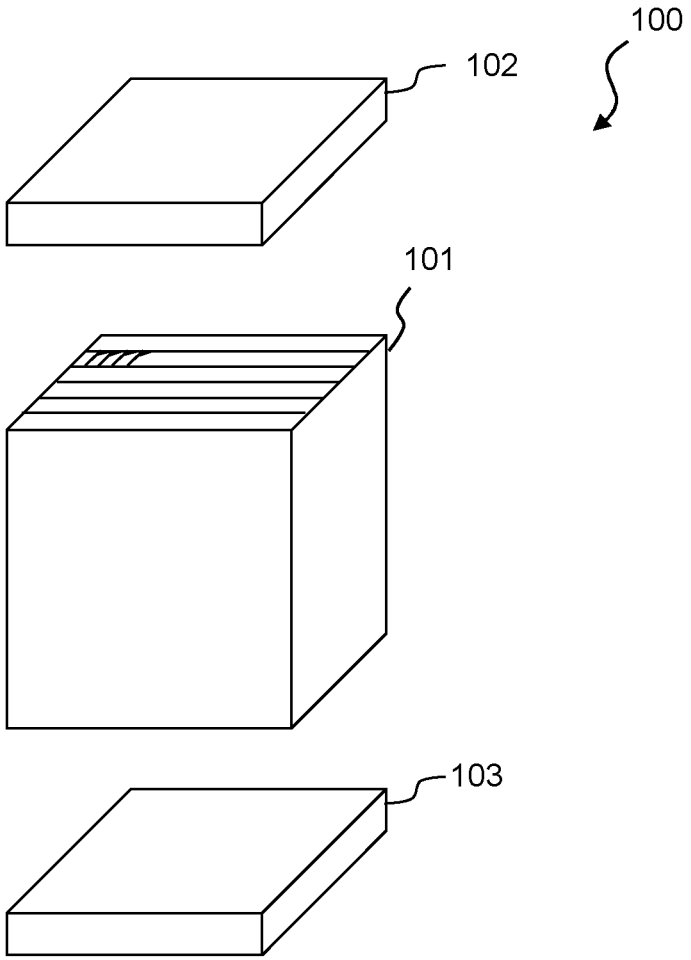
FIG. 6 is a perspective view of some parts of the heat exchanger according to an embodiment.

FIG. 6 is a perspective view of some parts of the heat exchanger according to an embodiment. The heat exchanger 100 comprises a heat exchanging unit 101. The heat exchanging unit 101 may comprise the flat sheets and profiled sheets forming the ducts of the first and second type as described above. The heat exchanger 100 further comprises a first coupling unit 102 arranged to couple a first external duct (not shown) on a first end of the ducts of the first type and to couple a second external duct to a first end of the ducts of the second type. The heat exchanger 100 further comprises a second coupling unit 103 arranged to couple a third external duct (not shown) on a second end of the ducts of the first type and to couple a fourth external duct to a second end of the ducts of the second type.

According to a preferred embodiment, at least the profiled sheets are formed from thermally deformable plastic. To produce the profiled sheets, plastic sheets are pressed between a mold and a contra mold having suitable cavities and extensions.

It is noted that the invention is not restricted to micro-channel heat exchangers. The proposed cross sections of the channels may as well be used in other types heat exchangers having larger dimensions. Furthermore it is noted that the sheets can be made of outer materials such as metal or ceramics.

The invention also relates to a method of operating a heat exchanger. The method comprises providing a heat exchanger according to any one of the preceding claims, leading a fluid of a first type through the ducts of the first type, and leading a fluid of a second type through the ducts of the second type. The fluid may be air, but alternatively, depending on the application, the fluid may be a gas or a liquid.

It should be noted that the above-mentioned embodiments illustrate rather than limit the invention, and that those skilled in the art will be able to design many alternative embodiments.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. A heat exchanger comprising a plurality of flat sheets arranged in parallel and a plurality of profiled sheets, each of the plurality of profiled sheets being arranged between two subsequent flat sheets of the plurality of flat sheets and having a repeating profile, and each of the plurality of profiled sheets comprising only straight segments, the profiled sheets and the flat sheets together creating a plurality of parallel ducts arranged in layers, the parallel ducts being divided by the profiled sheets into ducts of a first type and ducts of a second type, the ducts of the second type neighboring the ducts of the first type, wherein each duct of the first and second type has a width w(d) which is a function of a distance d with d the distance from a first flat sheet of the plurality of flat sheets, wherein a first region of the width is determined by the formula $w(d)=c1*d$ when $0 \le d \le d1$, a second region of the width is determined by the formula $w(d)=c1*d1+c2*(d-d1)$ when $d1 \le d < d2$, and a third region of the width is determined by the formula $w(d)=c1*d1+c2*(d2-d1)+c3*(d-d2)$ when $d2 \le d < d3$ in which d3 is a distance between the first flat sheet and a subsequent flat sheet of the plurality of flat sheets, and wherein d1, d2, c1, c2, c3 are constant values, wherein $c2 \neq c1,c3$, and wherein $0<d1<d2<d3$.

2. The heat exchanger according to claim 1, wherein $-2 \le c2 < 5$.

3. The heat exchanger according to claim 2, wherein $-0.3 \le c2 < 0.3$.

4. The heat exchanger according to claim 1, wherein $0.1 \le c1,c3 \le 5$.

5. The heat exchanger according to claim 1, wherein a cross section of each duct is symmetrical with reference to a perpendicular of the flat sheets.

6. The heat exchanger according to claim 1, wherein the plurality of parallel ducts formed by the flat sheets and the profiled sheets are non-symmetrical in cross section of a layer of the heat exchanger.

7. The heat exchanger according to claim 1, wherein c2=0.

8. The heat exchanger according to claim 1, wherein $c2<c1,c3$.

9. The heat exchanger according to claim 1, wherein at least the profiled sheets are formed from thermally deformable plastic.

10. The heat exchanger according to claim 1, wherein 1 mm<d3<10 mm.

11. The heat exchanger according to claim 1, wherein c1=c3.

12. The heat exchanger according to claim 1, wherein $d1=d3-d2$.

13. A method of operating a heat exchanger, the method comprising:

providing a heat exchanger comprising a plurality of flat sheets arranged in parallel and a plurality of profiled sheets, each of the plurality of profiled sheets being arranged between two subsequent flat sheets of the plurality of flat sheets and having a repeating profile, and each of the plurality of profiled sheets comprising only straight segments, and the profiled sheets and the flat sheets together creating a plurality of parallel ducts arranged in layers, the parallel ducts being divided by the profiled sheets into ducts of a first type and ducts of a second type, the ducts of the second type neighboring the ducts of the first type, wherein each duct of the first and second type has a width w(d) which is a function of a distance d with d the distance from a first flat sheet of the plurality of flat sheets, wherein a first region of the width is determined by the formula $w(d)=c1*d$ when $0\leq d<d1$, a second region of the width is determined by the formula $w(d)=c1*d1+c2*(d-d1)$ when $d1\leq d<d2$, and a third region of the width is determined by the formula $w(d)=c1*d1+c2*(d2-d1)+c3*(d-d2)$ when $d2\leq d<d3$ wherein d3 is a distance between the first flat sheet and a subsequent flat sheet of the plurality of flat sheets, and wherein d1, d2, c1, c2, c3 are constant values, wherein $c2\neq c1,c3$, and wherein $0<d1<d2<d3$;

leading a fluid of a first type through the ducts of the first type; and leading a fluid of a second type through the ducts of the second type.

14. The heat exchanger according to claim 1, wherein each of the plurality of parallel ducts comprises a rectangular shaped part and at least two triangular shaped parts.

15. The heat exchanger according to claim 1, wherein each transition at each of the ducts of the first type to each of the ducts of the second type at each of the plurality of flat sheets is formed by a bend or fold in the plurality of profiled sheets forming an angle between adjacent ones of the straight segments such that a single point of contact is provided at each interface between the plurality of profiled sheets and one of the plurality of flat sheets.

16. The heat exchanger according to claim 1, wherein the width w(d) of each duct of at least the first type increases linearly from 0 to d1, increases linearly from d1 to d2, and increases linearly from d2 to d3.

17. The heat exchanger according to claim 16, wherein an amount of the linear increase in the width w(d) from each of 0 to d1 and d2 to d3 is greater than an amount of the linear increase in the width w(d) from d1 to d2.

* * * * *